US006374560B1

(12) United States Patent
Schiedegger et al.

(10) Patent No.: US 6,374,560 B1
(45) Date of Patent: Apr. 23, 2002

(54) PLASTIC BATTEN SHUTTER

(75) Inventors: Charles E. Schiedegger, Metamora; Dean Douglas Dennis, Lapeer, both of MI (US)

(73) Assignee: Tapco International Corporation, Plymouth, MI (US)

( * ) Notice: Subject to any disclaimer, the term of this patent is extended or adjusted under 35 U.S.C. 154(b) by 0 days.

(21) Appl. No.: 09/696,488

(22) Filed: Oct. 25, 2000

(51) Int. Cl.[7] ..... E04C 2/38

(52) U.S. Cl. ..... 52/475.1; 52/473; 52/314; 52/479; 52/306; 52/309.5; 52/476; 52/202; 52/203; 52/664; 52/665; 52/666; 52/669; 52/311.2; 52/311.3; 256/59; 256/65; 256/66; 256/67; 256/19; 403/270; 403/271; 403/272

(58) Field of Search ..... 52/473, 314, 479, 52/306, 309.5, 482, 475, 476, 455, 586.2, 800.12, 311, 2, 458, 745.19, 800.1, 800.13, 316, 475.1, 311.3, 202, 203, 664, 665, 666, 669

(56) References Cited

U.S. PATENT DOCUMENTS

| | | | | |
|---|---|---|---|---|
| 3,886,703 A | | 6/1975 | Rousey | 52/473 |
| 4,020,609 A | | 5/1977 | Daniels | 52/473 |
| 4,184,300 A | | 1/1980 | Deschamps | 52/473 |
| 4,858,400 A | | 8/1989 | Foyt | 52/98 |
| 5,152,116 A | | 10/1992 | MacGowan | 52/473 |
| 5,622,018 A | | 4/1997 | Schiedegger | 52/211 |
| 5,704,182 A | | 1/1998 | Schiedegger | 52/457 |
| 5,761,865 A | | 6/1998 | Schiedegger et al. | 52/473 |
| 5,971,365 A | * | 10/1999 | Pigott et al. | 256/65 |
| 6,122,875 A | * | 9/2000 | Schiedegger et al. | 52/457 |
| 6,219,985 B1 | * | 4/2001 | Hsu | 52/473 |

* cited by examiner

*Primary Examiner*—Carl D. Friedman
*Assistant Examiner*—Chi Nguyen
(74) *Attorney, Agent, or Firm*—Howard & Howard

(57) ABSTRACT

A decorative shutter assembly includes a plurality of slats arranged in a row presenting a decorative surface with side flanges projecting rearwardly. At least one cross member overlays each of the slats and presents a decorative cross surface with side cross flanges projecting rearwardly. Each cross slat includes at least one mating member affixed behind the cross slat decorative surface having a mating wall affixed to each of the decorative surfaces for affixing the plurality batten slats to the cross slat. Alternatively, a plurality of primary slats are arranged to present a decorative surface having side flanges projecting rearwardly and at least one end piece is attached to the primary slats the ends of the primary slats are received in the end piece for adjoining and aligning said primary slats, said end piece including a cross member traversing said the primary and having slats and slat ends integrated into the end piece, each of said slats and slat ends aligning with one of the primary slats.

20 Claims, 4 Drawing Sheets

FIG-4
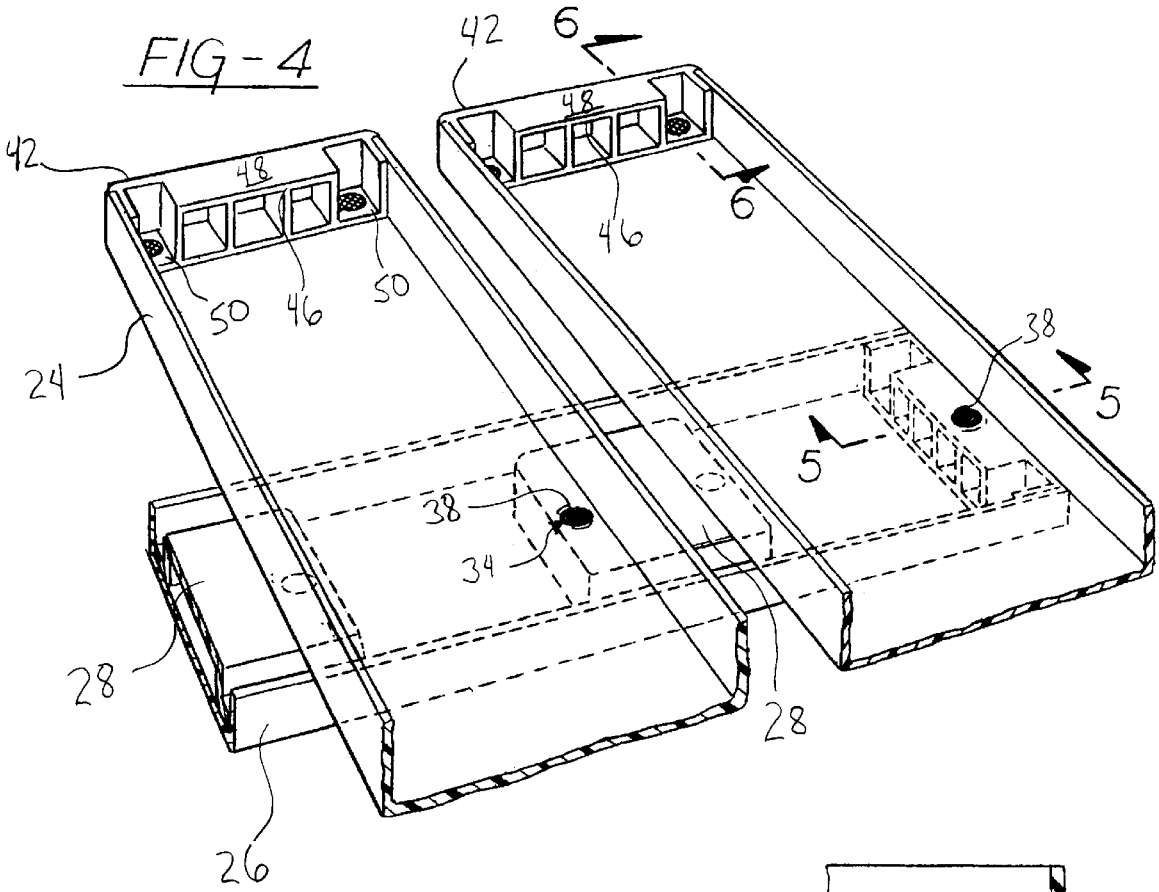
FIG-5
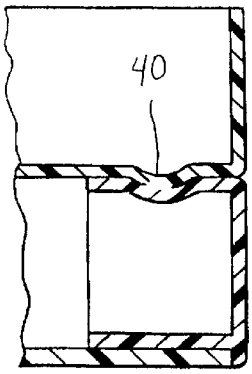
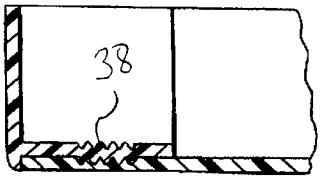
FIG-6

PLASTIC BATTEN SHUTTER

BACKGROUND OF THE INVENTION

The present invention relates to a decorative building shutter for mounting on a wall surface. More specifically, the present invention relates to an improved plastic batten shutter.

Decorative building panels, such as shutters, are widely used in the building industry to add character to a house or other type of building structure. Additionally, decorative building panels are frequently installed on existing structures to change the appearance of the structure. A popular type of building panel that is used is a window shutter. These shutters, which are typically not functional, present a decorative facade that gives the appearance of being a functional shutter.

One popular style of shutter is commonly referred to as a batten shutter. The batten shutter includes a plurality of batten slats arranged vertically in a row. At least one, and usually two, cross slats overlay each of the batten slats. The cross slats adjoin the batten slats forming the batten shutter assembly. A simulated plastic batten shutter commonly includes slats having a decorative surface and flanges projecting rearward from the surface creating a hollow slat that gives the appearance of being a complete wooden slat. While the plastic materials reduce the cost of producing the batten shutter, connecting the slats together is a labor intensive and costly operation.

One such example is U.S. Pat. No. 4,184,300 to Deschamps. Deschamps discloses a batten shutter having plastic batten slats with decorative surface and side flanges. Each batten slat is affixed to a cross slat with pin. Utilizing pins to connect the batten slats to the cross slats adds cost and assembly time due to the increased number of parts required for assembly.

Therefore, it would be desirable to provide a batten shutter that is simple to produce and yet presents the appearance of being assembled from real wood.

SUMMARY OF THE INVENTION AND ADVANTAGES

The present invention discloses a decorative shutter assembly having a plurality of batten slats arranged in a row and connected together by at least one cross slat. Each batten slat presents a batten decorative surface having side batten flanges projecting rearward. Each cross slat overlays the batten slats and presents a decorative cross surface with side cross flanges projecting rearward. Each cross slat includes at least one mating member affixed behind the cross-decorative surface with a mating wall affixed to each of the batten decorative surfaces. The slats are affixed to the mating member by sonic welding or heat welding. Each of the slats includes end plugs at each end to present a finished appearance of being a complete wooden board.

The inventive batten shutter provides a simple design that is easily produced and presents the appearance of being made from wooden boards. The mating member maximizes the amount of extrusion processing that can be utilized enabling a single extruder to be used for both the cross slats and the batten slats by providing a mating surface to the batten slats. Further, hiding the mating surface behind the cross slat provides the ability to form an attachment point from either a sonic weld or a heat weld.

BRIEF DESCRIPTION OF THE DRAWINGS

Other advantages of the present invention will be readily appreciated as the same becomes better understood by reference to the following detailed description when considered in connection with the accompanying drawings wherein:

FIG. 4 is a sectional perspective view of a comer of the batten shutter of the subject invention;

FIG. 5 is sectional view along line 5—5 of FIG. 4 showing a heat weld;

FIG. 6 is a sectional view along line 6—6 of FIG. 4 showing a sonic weld;

FIG. 7 is an exploded view of an alternate embodiment of the batten shutter of the subject invention.

DETAILED DESCRIPTION OF THE PREFERRED EMBODIMENT

Figure 1:
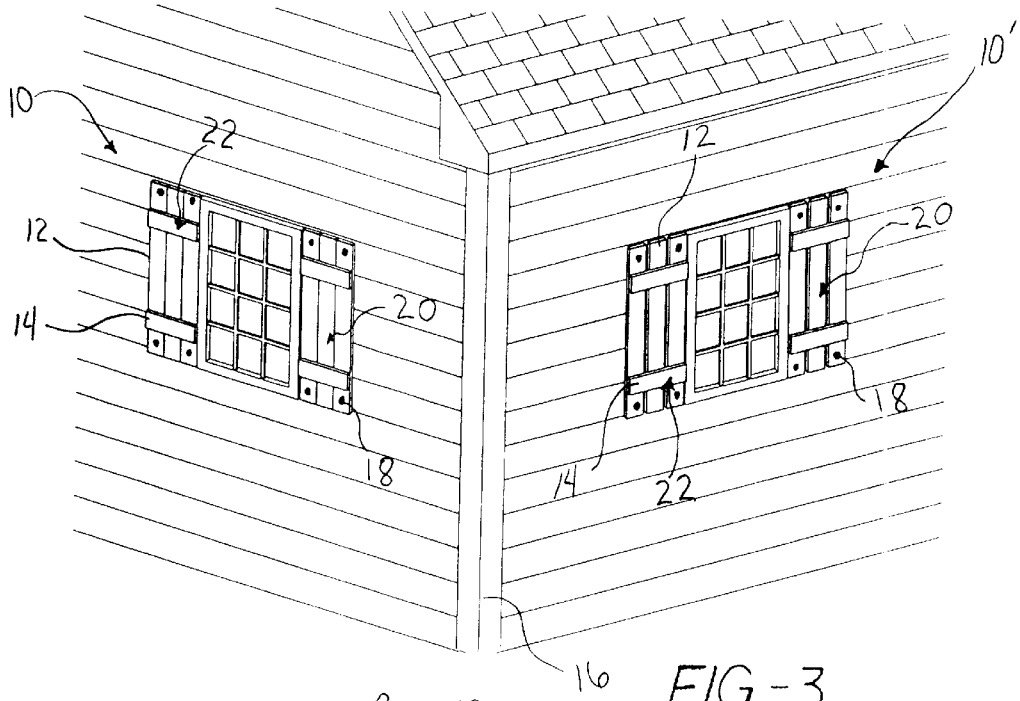
FIG. 1 is an environmental view of the batten shutter of the subject invention.

Referring to the FIG. 1, wherein like numerals indicate like or corresponding parts, a decorative shutter assembly is generally shown at 10. A plurality of batten slats 12 are arranged in a row and at least one cross slat 14 overlays each of the batten slats 12. FIG. 1 shows the assembly 10 having two cross slats 14. The assembly 10 is mounted to a house 16 with fasteners 18 disposed in each corner of the assembly 10. Any type of fastener 18 will suffice including screws, shutter locks, and the like. The batten slats 12 include a batten decorative surface 20 and the cross slat 14 includes a cross-decorative surface 22.

Figure 3:
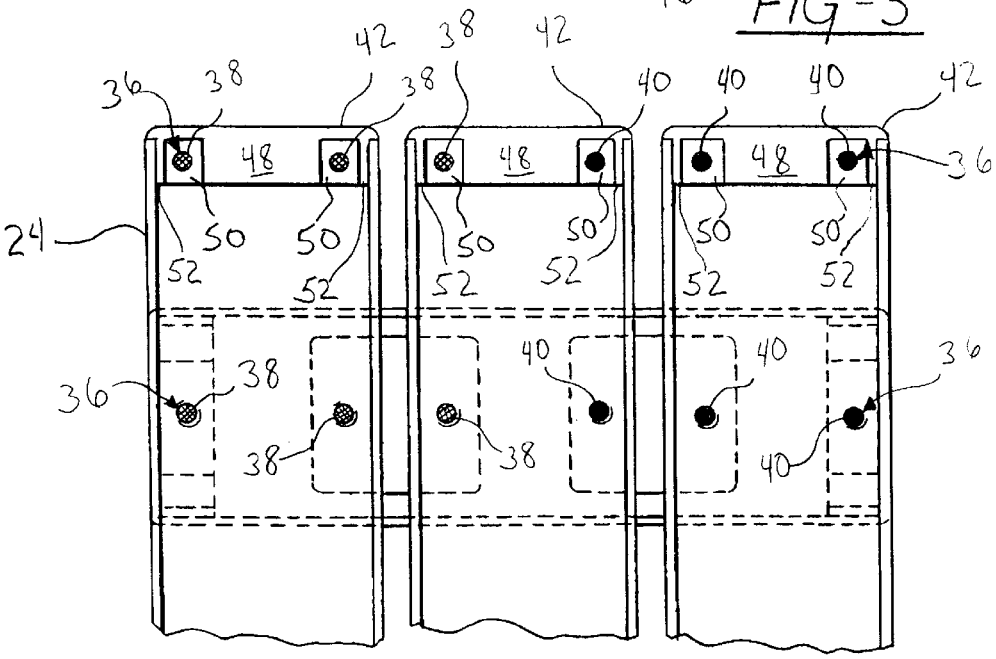
FIG. 3 is a rear view of the batten shutter of the subject invention showing the attachment points.
Figure 2:
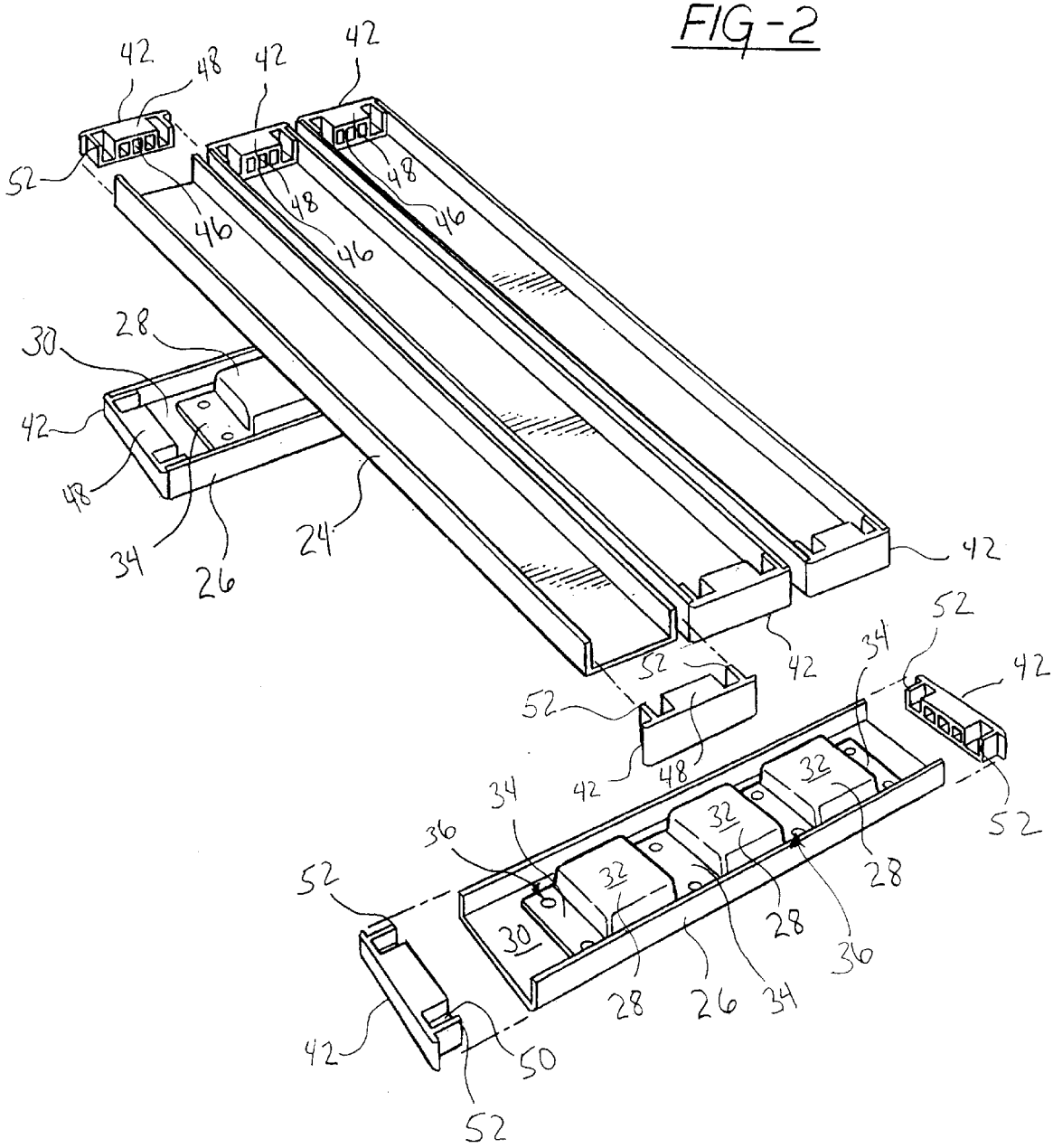
FIG. 2 is a rear partially exploded view of the batten shutter of the subject invention.

Referring to FIGS. 2, 3, and 4, each batten slat 12 includes side batten flanges 24 projecting rearward from the batten decorative surface 20 running the length of the batten slat 12. Each cross slat 14 includes side cross flanges 26 projecting rearward from the cross decorative surface 22 running the length of the cross slat 14.

Each of the slats 12, 14 is preferably formed through a plastic extrusion process from polypropylene or a like material. Additionally, the material can be formed in a variety of colors including ultra violet (UV) adsorbents to prevent fading and warping due to UV damage as is commonly practiced in the art of composite building components.

Each cross slat 14 includes at least one mating member 28 affixed behind the cross-decorative surface 22 to a rear cross surface 30. The mating member 28 forms a shell having a mating wall 32 and base wall 34. The base wall 34 is affixed to the rear cross surface 30 of the cross slat 14 and the mating wall 32 is affixed to each of the batten decorative surfaces 20 thereby affixing the plurality batten slats 12 to at least one cross slat 14. Preferably, the assembly 10 will include one less mating member 28 than the number of batten slats 12. Thus, each mating member 28 will straddle adjacent batten slats 12 as is best represented in FIG. 3.

Each mating member 28 is affixed to the cross slat 14 and to the batten slats 12 by a plurality of mating attachment points 36. The attachment points 36 comprise sonic welds 38. Alternatively, the attachment points 36 comprise heat welds 40. FIG. 3 represents some of the attachment points 36 as sonic welds 38 and some of the attachment points as heat welds 40. FIG. 5 shows an example of a heat weld 40 distorting both surfaces that are being welded together. FIG. 6 shows an example of a sonic weld 38 wherein only the weld surface is distorted. Preferably, sonic welds 38 will be utilized when making an attachment point 36 to a visible decorative surface 20, 22.

Each of the slats 12, 14 includes an end plug 42 disposed between each of the flanges 24, 26 at each end of the slats 12, 14. Each end plug 42 includes a plug decorative surface 44 that, when in place, gives the slats 12, 14 the appearance of being a complete wooden board. Each end plug 42 includes a mating rib 46 disposed behind the plug decorative surface 44. The mating rib 46 defines a forward mating wall 48 and a rearward mating wall 50.

The forward mating wall 48 is affixed to the slats 12, 14 behind the decorative surface 20, 44 by either a sonic weld 38 or a heat weld 40. The rearward mating wall 50 is affixed to adjacent batten decorative surfaces 20 by either a sonic weld 38 or a heat weld 40. The type of attachment 34 chosen depends upon processing time and the visibility of the decorative surface 20, 44.

The mating rib 46 includes opposing flange mating walls 52 separated by the forward and rearward mating walls 48, 50. Each flange mating wall 52 abuts one of the flanges 24, 26 for providing support to the flanges 24, 26.

The batten slats 12 are arranged in spaced pattern in a row. This is best represented in FIG. 1 at 10'. Alternatively, to achieve a different appearance, the batten slats 12 can be arranged in an adjacent pattern in a row. This is best represented in FIG. 1 at 10.

Figure 8:
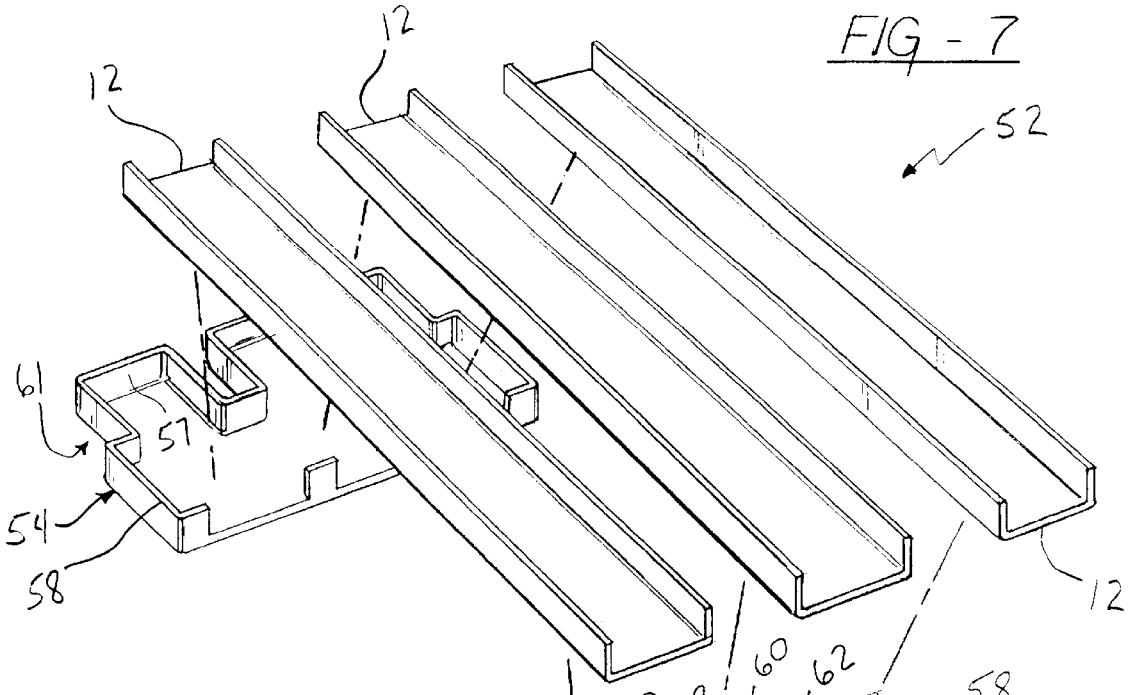
FIG. 8 is a rear view of the inventive connecting element or end piece as utilized in the embodiment illustrated in FIG. 7.

An alternate assembly 52 is shown in FIGS. 7 and 8. The alternate assembly 52 includes a plurality of batten slats 12, none of which have end plugs 42. A connecting element 54 is positioned at each end of the batten slats 12 and adjoins the batten slats 12 thereby forming the alternate assembly 52. The connecting element 54 includes a plurality of batten end slats 56 equal in number to the batten slats 12 utilized in the alternate assembly 52. The batten end slats 56 include an end wall 57 and side end slat flanges 59, each projecting rearward from a batten end slat decorative surface 61 thereby giving the appearance that the batten end slats 56 are complete wooden boards. The connecting element 54 includes a cross member 58 that traverses the batten slats 12 giving the appearance of being a cross slat 14.

The cross member 58 includes opposing first and second side cross member flanges 60, 63. The first side cross member flange 60 includes a plurality of notches 62. Each notch receives one of the batten slats 12. Each batten slat 12 is affixed to connecting element 54 behind the cross member 58 by either sonic welding or heat welding. The connecting element 54 is affixed to each end of the plurality of batten slats 12 giving the appearance that the batten slats 12 run the full length of the alternate assembly.

The connecting element 54 is preferably injection molded for providing the necessary detail to the alternate assembly 52. However, the batten slats 12 can be extruded to reduce processing costs. Each batten slat 12 is affixed to each integrated end slat with one attachment point 36. Therefore, the entire number of attachment points 36 is only twice the number of batten slats 12.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A decorative shutter assembly comprising:

a plurality of main slats arranged substantially parallel to one another presenting a decorative surface having flanges projecting rearward therefrom; and at least one cross slat overlaying each of said main slats and presenting a decorative cross surface having side cross flanges projecting rearwardly therefrom;

wherein said cross slat includes at least one mating member affixed behind said decorative cross surface, and having a mating wall affixed to each of said decorative surfaces thereby affixing at least one of said plurality of main slats to said at least one cross slat.

2. An assembly as set forth in claim 1 wherein said at least one mating member is affixed to said cross slat and to said main slats by a plurality of sonic welds.

3. An assembly as set forth in claim 1 wherein said at least one mating member is affixed to said cross slat and to said main slats by a plurality of heat welds.

4. An assembly as set forth in claim 1 wherein each of said main slats includes an end plug disposed between each of said flanges at each end of said main slats.

5. An assembly as set forth in claim 4 wherein where of said end plugs includes a plug decorative surface having a mating rib disposed to define a forward mating wall and a rearward mating wall.

6. An assembly as set forth in claim 5 wherein said forward mating wall is affixed to said main slats behind said plug decorative surface with a weld.

7. An assembly as set forth in claim 6 wherein said rearward mating wall is affixed to adjacent of said decorative surface with a weld.

8. An assembly as set forth in claim 7 wherein said mating rib includes opposing flange mating walls separated by said forward and rearward mating walls, each abutting one of said flanges for providing support to said flanges.

9. An assembly as set forth in claim 1 wherein said main slats are spaced apart in a row.

10. An assembly as set forth in claim 8 wherein said main slats are adjacent to one another and have a side that comes into contact with the side of at least one of the other main slats.

11. A decorative shutter assembly comprising:

a plurality of batten slats arranged in a row presenting a batten decorative surface having batten side flanges projecting rearward therefrom;

a connecting element receiving the ends of said plurality of batten slats for adjoining said plurality of batten slats in said row; and said connecting element including a cross member traversing said plurality of batten slats and having batten end slats projecting therefrom, each of said batten end slats aligning with one of said batten slats.

12. A decorative shutter assembly as set forth in claim 11 wherein said cross member includes first and second opposing cross side flanges and a cross member decorative surface, said cross side flanges projecting rearward from said cross member decorative surface.

13. A decorative shutter assembly as set forth in claim 12 wherein said batten end slats project outwardly from said first cross side flange.

14. A decorative shutter assembly as set forth in claim 13 wherein said second cross side flange includes a plurality of notches, each notch receiving one of said batten slats.

15. A decorative shutter assembly as set forth in claim 11 wherein each of said batten slats is affixed to said connecting element by one of sonic welding and heat welding.

16. A decorative shutter assembly as set forth in claim 11 wherein each of said batten end slats includes a decorative end slat surface having opposing side end slat flanges projecting rearward therefrom.

17. A decorative shutter assembly as set forth in claim 16 wherein each of said batten end slats includes an end wall disposed at a distal end thereof.

18. A decorative shutter assembly as set forth in claim 11 wherein said batten slats are spaced apart in said row.

19. A decorative shutter assembly as set forth in claim 11 wherein said batten slats are arranged adjacent in said row.

20. A decorative shutter assembly comprising:

a plurality of primary slats arranged to present a decorative surface having side flanges projecting rearward therefrom; and an end piece having means for receiving the ends of said plurality of slats for adjoining and aligning said plurality of slats in said row, said end piece including a cross member traversing said plurality of primary slats and having slats and slat ends integrated into the end piece, each of said slats and slat ends aligning with one of said primary slats.

* * * * *